US010428701B2

(12) United States Patent
Altherr et al.

(10) Patent No.: US 10,428,701 B2
(45) **Date of Patent: *Oct. 1, 2019**

(54) VALVE DRIVE FOR AN INTERNAL COMBUSTION ENGINE

(71) Applicant: Mahle International GmbH, Stuttgart (DE)

(72) Inventors: Patrick Altherr, Stuttgart (DE); Thorsten Ihne, Stuttgart (DE); Markus Walch, Bretten (DE)

(73) Assignee: Mahle International GmbH (DE)

( * ) Notice: Subject to any disclaimer, the term of this patent is extended or adjusted under 35 U.S.C. 154(b) by 0 days.

This patent is subject to a terminal disclaimer.

(21) Appl. No.: 15/936,375

(22) Filed: Mar. 26, 2018

(65) Prior Publication Data

US 2018/0274403 A1 Sep. 27, 2018

(30) Foreign Application Priority Data

Mar. 27, 2017 (DE) ..... 10 2017 205 155

(51) Int. Cl.
*F01L 13/00* (2006.01)
*F01L 1/047* (2006.01)
(Continued)

(52) U.S. Cl.
CPC ..... *F01L 13/0005* (2013.01); *F01L 1/04* (2013.01); *F01L 1/047* (2013.01); *F01L 1/053* (2013.01);
(Continued)

(58) Field of Classification Search
CPC ... F01L 1/047; F01L 1/053; F01L 1/08; F01L 1/46; F01L 13/0005; F01L 13/0036
(Continued)

(56) References Cited

U.S. PATENT DOCUMENTS 7,066,145 B2 6/2006 Hashizume et al.
7,493,878 B2 2/2009 Schon et al.
(Continued)

FOREIGN PATENT DOCUMENTS

DE 30 06 619 A1 8/1981
DE 19945340 A1 3/2001
(Continued)

OTHER PUBLICATIONS

English abstract for DE-202015009047.
(Continued)

*Primary Examiner* — Jorge L Leon, Jr.
(74) *Attorney, Agent, or Firm* — Fishman Stewart PLLC

(57) ABSTRACT

A valve drive for an internal combustion engine may include a cam shaft, at least one cam follower, at least one adjusting device, and at least one control shaft. The cam shaft may include at least one cam group that may include a first cam and a second cam The at least one adjusting device may include a first adjustable engagement element and a second adjustable engagement element. The at least one control shaft may include at least one control cam group that may include a first control cam and a second control cam. The first control cam may include a cam lobe corresponding to the first engagement element and the second control cam may include a cam lobe corresponding to the second engagement element. The at least one control shaft may be rotatable about a longitudinal axis between a starting position and a rotational position.

14 Claims, 3 Drawing Sheets

(51) Int. Cl.

| | |
|---|---|
| ***F01L 1/22*** | (2006.01) |
| ***F01L 1/04*** | (2006.01) |
| ***F01L 1/053*** | (2006.01) |
| ***F01L 1/12*** | (2006.01) |
| ***F01L 1/18*** | (2006.01) |
| *F01L 1/02* | (2006.01) |
| *F01L 1/26* | (2006.01) |

(52) U.S. Cl.
CPC ..... *F01L 1/12* (2013.01); *F01L 1/181* (2013.01); *F01L 1/22* (2013.01); *F01L 13/00* (2013.01); *F01L 13/0036* (2013.01); *F01L 1/024* (2013.01); *F01L 1/026* (2013.01); *F01L 1/267* (2013.01); *F01L 2013/001* (2013.01); *F01L 2013/0052* (2013.01); *F01L 2013/10* (2013.01); *F01L 2105/00* (2013.01)

(58) Field of Classification Search
USPC ..... 123/90.16, 90.17, 90.21, 90.27
See application file for complete search history.

(56) References Cited

U.S. PATENT DOCUMENTS

| | | | | |
|---|---|---|---|---|
| 2009/0194048 | A1 | 8/2009 | Schoen et al. | |
| 2010/0139594 | A1* | 6/2010 | Wutzler ..... | F01L 13/0036 123/90.17 |
| 2011/0315103 | A1* | 12/2011 | Kim ..... | F01L 1/053 123/90.16 |
| 2017/0198613 | A1* | 7/2017 | Raimondi ..... | F01L 1/185 |
| 2017/0284238 | A1* | 10/2017 | Son ..... | F01L 1/047 |
| 2017/0284314 | A1* | 10/2017 | Son ..... | F01L 1/053 |

FOREIGN PATENT DOCUMENTS

| | | | |
|---|---|---|---|
| DE | 103 12 961 | B3 | 5/2004 |
| DE | 10 2004 040 537 | A1 | 4/2005 |
| DE | 102004033963 | A1 | 2/2006 |
| DE | 10 2005 010 484 | B3 | 10/2006 |
| DE | 10 2005 021 114 | A1 | 11/2006 |
| DE | 10 2007 037 332 | A1 | 2/2009 |
| DE | 202015009047 | U1 | 8/2016 |
| EP | 0 179 990 | A2 | 5/1986 |
| WO | 2015180 896 | A1 | 12/2015 |

OTHER PUBLICATIONS

English abstract for DE-10 2005 021 114.
English abstract for DE-19945340.
English abstract for DE-102004033963.
English abstract for DE-102007037332.
English abstract for DE-30 06 619.

* cited by examiner

VALVE DRIVE FOR AN INTERNAL COMBUSTION ENGINE

CROSS-REFERENCE TO RELATED APPLICATIONS

This application claims priority to German Patent Application No. DE 10 2017 205 155.8, filed on Mar. 27, 2017, the contents of which are hereby incorporated by reference in its entirety.

TECHNICAL FIELD

The invention at hand relates to a valve drive for an internal combustion engine comprising a cam shaft and comprising a cam follower.

BACKGROUND

Generic valve drives for an internal combustion engine comprising a cam shaft and comprising at least one cam follower as well as comprising a cam group, which is mounted to the cam shaft in a rotatably fixed manner, comprising a first cam and comprising a second cam axially adjacent to the first cam, are already known. In a first position, the cam follower is thereby drivingly connected to the first cam of the respective cam group and, in a second position, to the second cam of the respective cam group.

The cam follower can be switched between the first position and the second position by means of an adjusting device and can thus switch on or switch off a corresponding cylinder of the internal combustion engine. To control the adjusting device, the valve drive known from the prior art has a control shaft, which is supported in a rotatably and axially displaceable manner and which controls the adjusting device by means of a control cam group, which is mounted to the control shaft.

In the case of the control shaft, which is known from the prior art, it is disadvantageous, however, that the control of the adjusting device is only possible by means of a complex motion sequence—for example of a rotation, which is combined with an axial displacement. This does not only lead to comparatively longer control times, but also increases the production and repair costs. A separate control of the individual cylinders can furthermore not be realized or can only be realized with a large effort.

SUMMARY

It is thus the object of the invention to specify an alternative embodiment for a valve drive of the generic type, in the case of which the control of the individual cylinders is realized by means of a simplified motion sequence and a separate control of the individual cylinders is made possible with a reduced effort.

According to the invention, this object is solved by means of the subject matter of independent claim(s). Advantageous embodiments are the subject matter of the dependent claim(s).

The present invention is based on the general idea of specifying a control shaft of a valve drive, in the case of which the control of the individual cylinders can be realized by means of a simplified motion sequence for the first time. For this purpose, the valve drive has a cam shaft and at least one cam follower, wherein the cam shaft has at least one cam group, which is mounted to the cam shaft in a rotationally fixed manner, comprising a first cam and comprising a second cam axially adjacent to the first cam. In a first position, the respective cam follower is drivingly connected to the first cam of the respective cam group and, in a second position, to the second cam of the respective cam group. To adjust the cam follower into the first position or into the second position, the valve drive has at least one adjusting device, which has a first adjustable engagement element and a second adjustable engagement element. The first engagement element thereby cooperates with a first guide, which is arranged on the cam shaft, and the second engagement element cooperates with a second guide, which is arranged on the cam shaft. The first engagement element and the second engagement element can alternately be adjusted between an initial position and a switching position, whereby there is no contact with the corresponding guide in the initial position and the respective engagement element cooperates with the corresponding guide in the switching position. The valve drive also has at least one control shaft comprising at least one control cam group, wherein the control cam group has a first control cam, which is mounted to the control shaft, and a second control cam, which is mounted to the control shaft. According to the invention, the control shaft can be brought from a starting position into a pivot position about a longitudinal axis, and the first control cam has a cam lobe for the respective first engagement element, and the second control cam has a cam lobe for the respective second engagement element. In the pivot position, the first control cam can adjust the first engagement element into the switching position by means of the cam lobe, and the second control cam can adjust the second engagement element into the switching position by means of the cam lobe in an alternating manner. When a cylinder is switched on, the control shaft is brought into the pivot position with a switch-on angle, and the first control cam adjusts the first engagement element from the initial position into the switching position. The control shaft returns into the starting position, the cylinder remains switched on. To switch off the cylinder, the control shaft is brought into the rotational position with a switch-off angle, and the second control cam adjusts the second engagement element from the initial position into the switching position. The cylinder is now switched off. With the cam lobe at the respective control cams, it is additionally attained that the mechanical stress on the respective engagement elements is reduced and that the switch-on times as well as the switch-off times of the individual cylinders are shortened. A reliable control of corresponding cylinders by simply pivoting the control shaft has now been realized by means of the valve drive according to the invention, so that a complex motion sequence is not necessary and the control times as well as the production and the repair costs can be reduced.

In a further development of the solution according to the invention, provision is advantageously made for the valve drive to have a control shaft comprising a plurality of control cam groups, wherein the corresponding adjusting device comprising the corresponding cam follower can be activated by means of the respective control cam group, and a corresponding cylinder can thus be switched on or switched off. When for example a first cylinder is switched on, the first control cam activates the corresponding adjusting device in a first control cam group, and the first control cams of other control cam groups do not have any contact with the respective first engagement element in this pivot position of the control shaft with a first switch-on angle. If the second cylinder is now connected to the first cylinder, the control shaft is pivoted about a second switch-on angle, and the first control cam in a second control cam group can activate the corresponding adjusting device. In this pivot position with the second switch-on angle, the first control cams of the other control cam groups as well as the second control cam of the first control cam group do not have any contact with the respective engagement element. The cylinder, which is controlled by the first control cam group, thus remains switched on, and the cylinder, which is controlled by the second control cam group, is switched on. In response to the switch-off, the control shaft is brought into the rotational/pivot position with a second switch-off angle and subsequently with a first switch-off angle, so that the switched-on cylinders can be switched off one after the other.

The control shaft comprising the individual control cam groups can thereby be embodied in such a way that all cylinders are switched in response to a first full pivoting and that all cylinders are switched off in response to a subsequent full pivoting of the control shaft. Advantageously, the individual cylinders can be switched or switched off in pairs or also one after the other.

Advantageously, a plurality of cylinders comprising a single control shaft can be switched on or switched off by means of a valve drive, which is embodied in this way, so that a simple design of the valve drive is possible, and the production costs and the repair costs can thus be reduced. In addition, the control times of the individual cylinders can be shortened, and any switching sequence can be realized for the individual cylinders.

In an alternative further development of the solution according to the invention, provision is advantageously made for the control shaft to have at least two partial control shafts each comprising at least one control cam group, wherein the corresponding adjusting device comprising the corresponding cam follower can be activated by means of the respective control cam group, and a corresponding cylinder can thus be switched on or switched off. For example, the first partial control shaft can thus control a first cylinder group, and the second partial control shaft can control a second cylinder group. The first and the second cylinder group can thereby differ in the number of cylinders. In the case of such an embodiment of the valve drive, the first cylinder group and the second cylinder group can advantageously be switched on or switched off individually. Provision is also made for the individual cylinders to each have a partial control shaft so as to be able to carry out the control of the valve drive in a particularly quick and flexible manner.

Provision is advantageously made for the control shaft to have an inner shaft and an outer shaft, which encases the inner shaft. The inner shaft is rotatably arranged in the rotationally fixed outer shaft, and the first control cam and the second control cam of the control cam group are mounted to the inner shaft in a rotationally fixed manner By means of a pivoting of the inner shaft into the pivot position, the first control cams can adjust the respective first engagement elements one after the other or in pairs, and the second control cams can adjust the respective second engagement elements one after the other or in pairs. The first and the second control cams can be mounted to the inner shaft, for example by means of connecting pins, so that the inner shaft comprising the control cams, which are mounted to the inner shaft can be rotated relative to the rotationally fixed outer shaft of the control shaft.

In an alternative further development of the control shaft, provision is advantageously made for the control shaft to have an inner shaft and an outer shaft, which encases the inner shaft, wherein the inner shaft and the outer shaft can be rotated relative to one another. The first control cams can thereby be mounted to the inner shaft in a rotationally fixed manner, and the second control cams can be mounted to the outer shaft in a rotationally fixed manner. In the alternative, the second control cams can be mounted to the inner shaft in a rotationally fixed manner, and the first control cams can be mounted to the outer shaft in a rotationally fixed manner. The individual cylinders are switched on by means of a pivoting of the inner shaft or the outer shaft, respectively, comprising the first control cams, and are switched off by means of a pivoting of the outer shaft or the inner shaft, respectively, comprising the second control cams. In the case of such an embodiment of the control shaft, it is also possible that only a portion of the cylinders can advantageously be switched on or switched off in any sequence either individually, one after the other or in pairs, and that the control of the cylinders can be carried out in a particularly flexible manner. The interactions—for example vibration transmission—are additionally also reduced in an advantageous manner between the first control cams and the second control cams.

In a particularly advantageous further development of the solution according to the invention, provision is made for the control shaft to be a rocker shaft comprising at least one rocker arm, which is rotationally arranged on the rocker shaft. The control shaft can thus be combined with the rocker shaft and the installation space for the valve drive can be reduced in an advantageous manner.

To provide for a rotation of the control shaft about a defined angle, provision is advantageously made for the valve drive to have a control shaft drive. The control shaft drive can be a belt drive or a gear drive or an adjusting drive, for example. The control shaft drive can also have a plurality of individual drives, which are arranged laterally or centrally on the control shaft.

A resetting of the control shaft into the starting position can be attained by means of a resetting arrangement, which has a spring reset comprising a torsion spring, a helical spring or a flexible spring, for example. An unwanted rotation of the control shaft can be avoided in an advantageous manner by means of the resetting arrangement.

Further important features and advantages of the invention follow from the subclaims, from the drawings, and from the corresponding figure description by means of the drawings.

It goes without saying that the above-mentioned features, and the features, which will be explained below, cannot only be used in the respective specified combination, but also in other combinations or alone, without leaving the scope of the invention.

Preferred exemplary embodiments of the invention are illustrated in the drawings and will be explained in more detail in the description below, whereby identical reference numerals refer to identical or similar or functionally identical components.

BRIEF DESCRIPTION OF THE DRAWINGS

In each case schematically.

DETAILED DESCRIPTION

Figure 1:
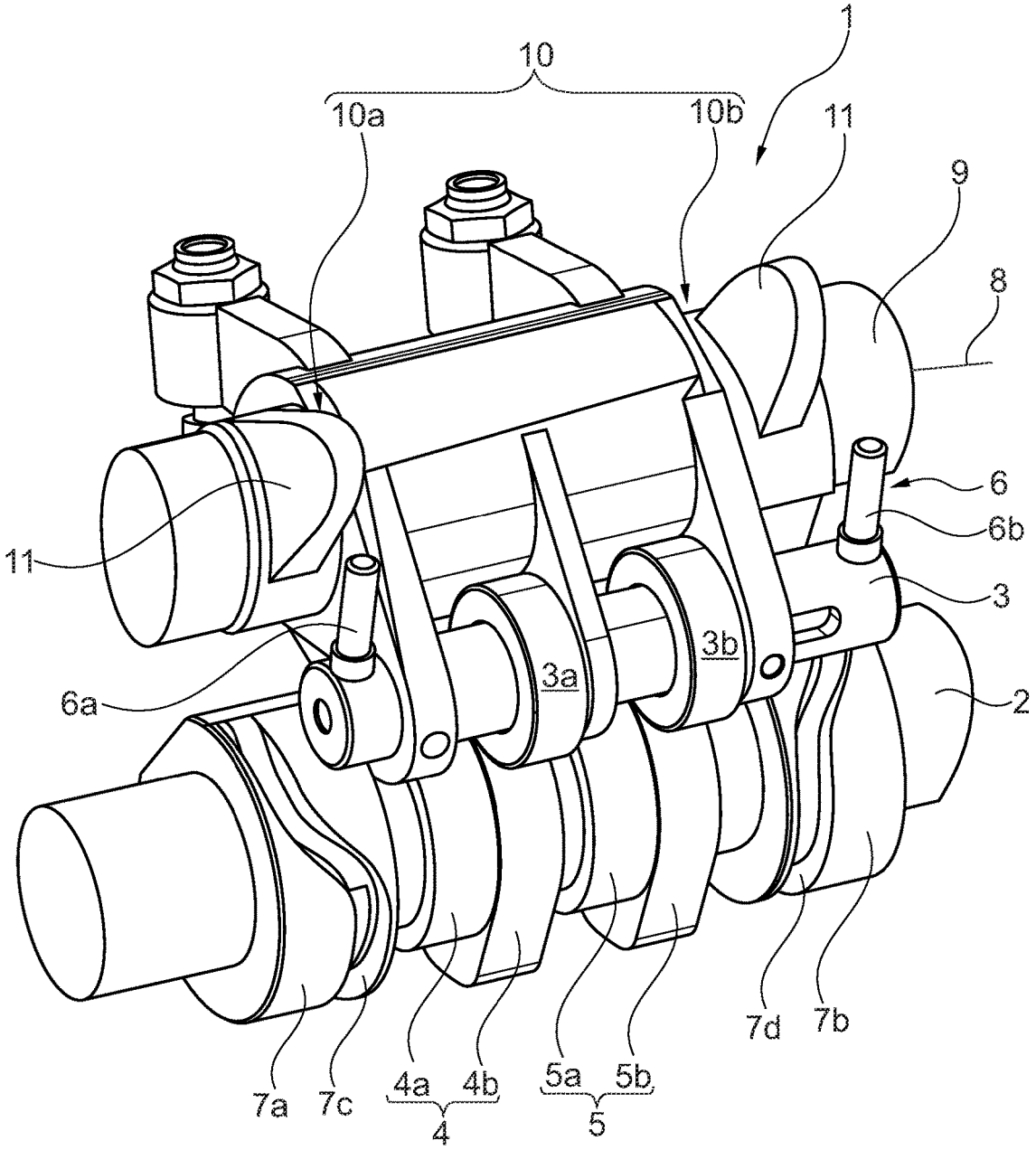
FIG. 1 shows a partial view of a valve drive according to the invention comprising a control shaft.

FIG. 1 shows a partial view of a valve drive 1 of an internal combustion engine, which is not shown in detail. The valve drive 1 has a cam shaft 2 and a cam follower 3. The cam shaft 2 has a first cam group 4 comprising a first cam 4*a* and comprising a second cam 4*b*, as well as a second cam group 5 comprising a first cam 5*a* and comprising a second cam 5*b*. The first cam group 4 and the second cam group 5 are mounted to the cam shaft 2 in a rotationally fixed manner A cylinder, which is not shown in detail, can be controlled by means of the first cam group 4 and the second cam group 5, in that for example the first cam group 4 controls an inlet valve of the cylinder, and the second cam group 5 controls an outlet valve of the cylinder.

The cam follower 3 is drivingly connected to the first cam group 4 by means of a first roller 3*a* and to the second cam group 5 by means of a second roller 3*b*. In a first position, the rollers 3*a* and 3*b* cooperate with the first cams 4*a* and 5*a* of the respective cam groups 4 and 5, and in a second position, the rollers 3*a* and 3*b* cooperate with the second cams 4*b* and 5*b* of the respective cam groups 4 and 5.

To adjust the cam follower 3 into the first position or into the second position, the valve drive 1 has an adjusting device 6, which has a first adjustable engagement element 6*a* and a second adjustable engagement element 6*b*. The first engagement element 6*a* thereby cooperates with a first guide 7*c* of a first slide guide 7*a*, which is mounted to the cam shaft 2, and the second engagement element 6*b* cooperates with a second guide 7*d* of a second slide guide 7*b*, which is mounted to the cam shaft 2. The first engagement element 6*a* and the second engagement element 6*b* can alternately be adjusted between an initial position and a switching position, whereby there is no contact with the corresponding slide guide 7*a* or 7*b* in the initial position, and the respective engagement element 6*a* or 6*b* cooperates with the corresponding slide guide 7*a* or 7*b* in the switching position.

The valve drive 1 also has a control shaft 9, which can be pivoted about a longitudinal axis 8 and which can be brought from a starting position into a rotational/pivot position. In this exemplary embodiment, the control shaft 9 and a rocker shaft of the valve drive 1 are combined. The control shaft 9 has a control cam group 10, wherein the control cam group 10 has a first control cam 10*a*, which is mounted to the control shaft 9 in a rotationally fixed manner, and a second control cam 10*b*, which is mounted to the control shaft 9 in a rotationally fixed manner According to the invention, the first control cam 10*a* and the second control cam 10*b* each have a cam lobe 11 for the engagement elements 6*a* and 6*b*, and a peripheral area 12. By means of the peripheral area 12, the control cams 10*a* and 10*b* are radially mounted to the control shaft 9. An axial mounting to the respective control cams 10*a* and 10*b* can thereby take place by means of a connecting pin, for example. In the pivot position, the first control cam 10*a* can adjust the first engagement element 6*a* into the switching position by means of the cam lobe 11, and the second control cam 10*b* can adjust the second engagement element 6*b* into the switching position by means of the cam lobe 11 in an alternating manner. To switch on or to switch off the individual cylinders, the control shaft 9 is pivoted about a switch-on angle or about a switch-off angle, so that either only the first control cam 10*a* has contact with the first engagement element 6*a* and can adjust the latter, or so that only the control cam 10*b* has contact with the second engagement element 6*b* and can adjust the latter.

By means of the valve drive 1 according to the invention, a control of corresponding cylinders is realized by simply a pivoting of the control shaft 9 into the pivot position with a switch-on angle or with a switch-off angle, so that a complex motion sequence is not necessary and so that the control times as well as the production and the repair costs can be reduced.

Figure 2:
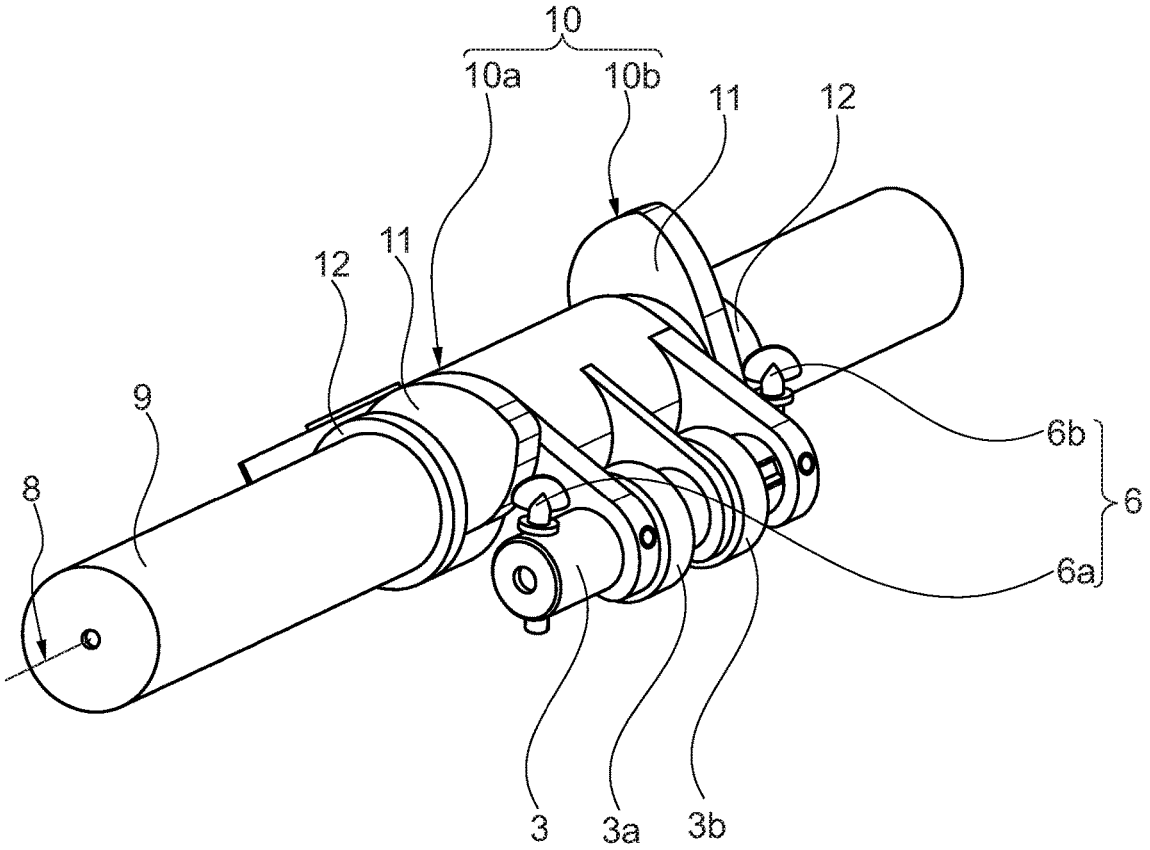
FIG. 2 shows a view of a control shaft comprising a control cam group.

FIG. 2 shows a view of the control shaft 9 comprising the control cam group 10. The control cams 10*a* and 10*b* are mounted to the control shaft 9, and the control shaft 9 can be pivoted from a starting position into a pivot position. The first control cam 10*a* and the second control cam 10*b* are arranged on the control shaft 9 so as to be rotatable relative to one another, so that the control shaft 9 is pivoted about a switch-on angle to switch on the corresponding cylinder and is pivoted about a switch-off angle to switch off the corresponding cylinder. The switch-on angle and the switch-off angle of the control shaft 9 differ from one another, so that the respective first engagement elements 6*a* or the respective second engagement elements 6*b* can be adjusted individually, one after the other or in pairs in the case of a plurality of control cam groups 10 and a plurality of cylinders, which are to be controlled, and the cylinders, which are to be controlled individually, can also be switched on or switched off individually, one after the other or in pairs. By means of an adaptation of the switch-on angles and of the switch-off angles of the individual first control cams 10*a* and the individual second control cams 10*b*, the order of the switch-on as well as the switch-on times of the individual cylinders can be changed.

Figure 3:
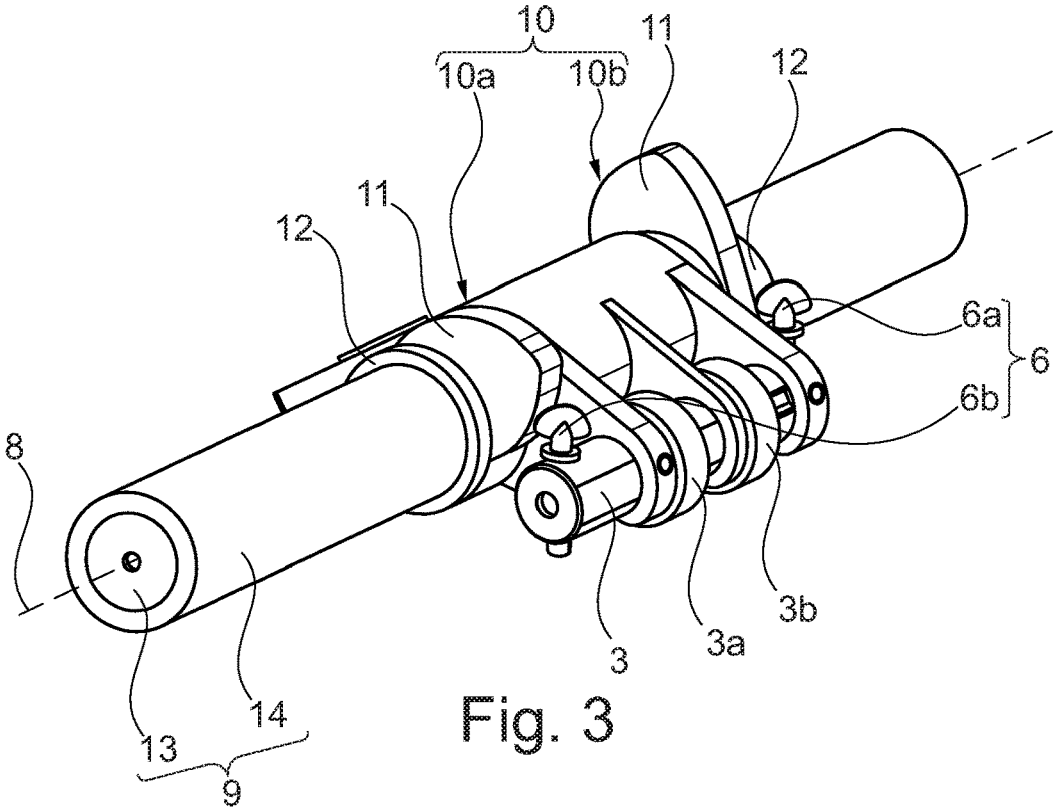
FIG. 3 shows a view of a control shaft comprising an inner shaft and comprising a rotationally fixed outer shaft.

FIG. 3 shows a view of the control shaft 9 comprising an inner shaft 13 and comprising an outer shaft 14. The inner shaft 13 is arranged in the rotationally fixed outer shaft 14 and can be rotated relative to the outer shaft 14. The first control cam 10*a* and the second control cam 10*b* can be mounted to the inner shaft 13, for example by means of connecting pins, so that the inner shaft 13 comprising the control cams 10*a* and 10*b*, which are mounted to the inner shaft 13, can be pivoted relative to the outer shaft 14 of the control shaft 9. By pivoting the inner shaft 13 into the pivot position, the first control cam 10*a* can thus adjust the first engagement element 6*a*, and the second control cam 10*b* can thus adjust the second engagement element 6*b* and can switch on or switch off the corresponding cylinder. An oil supply can occur for example by means of a hole in the inner shaft 13.

Figure 4:
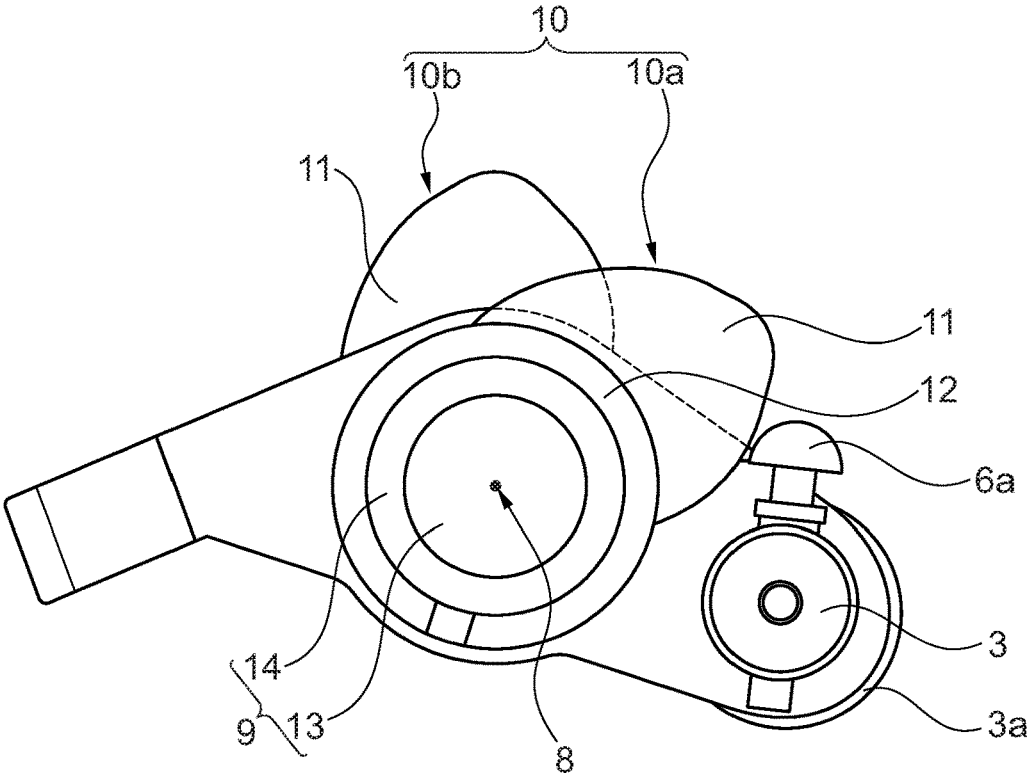
FIG. 4 shows a side view of a control shaft comprising an inner shaft and an outer shaft, wherein the inner shaft and the outer shaft can be rotated relative to one another.

FIG. 4 shows a view of the control shaft 9 comprising the inner shaft 13 and comprising the outer shaft 14, wherein the inner shaft 13 and the outer shaft 14 can be rotated relative to one another. The first control cam 10*a* is thereby mounted to the inner shaft 13 and the second control cam 10*b* to the outer shaft 14 in a rotationally fixed manner. In the alternative, the second control cam 10*b* can be mounted to the inner shaft 13 and the first control cam 10*a* can be mounted to the outer shaft 14 in a rotationally fixed manner. In this embodiment of the control shaft 9, the switch-on or switch-off of a plurality of cylinders comprising a control shaft 9 can only occur by means of a pivoting of the inner shaft 13 or of the outer shaft 14, so that more space is available for the individual first control cams 10*a* and for the individual control cams 10*b* on the circumference of the inner shaft 13 and of the outer shaft 14. An oil supply can occur for example by means of a hole in the inner shaft 13.

To make it possible to pivot the control shaft 9 about a defined angle, the valve drive 1 can have a control shaft drive, which can be a belt drive or a gear drive or an adjusting drive, for example. The control shaft drive can also have a plurality of individual drives, which can be arranged laterally or centrally on the control shaft 9. A resetting of the control shaft 9 into the starting position can also be attained by means of a resetting arrangement, which has a spring reset comprising a torsion spring, a helical spring or a flexible spring, for example.

The invention claimed is:

1. A valve drive for an internal combustion engine, the valve drive comprising:

a cam shaft including at least one cam group mounted to the cam shaft in a rotationally fixed manner, the at least one cam group including a first cam and a second cam axially adjacent to the first cam;

at least one cam follower, wherein, in a first position, the at least one cam follower is drivingly connected to the first cam and, in a second position, to the second cam;

at least one adjusting device, the at least one adjusting device including a first adjustable engagement element and a second adjustable engagement element;

wherein the first engagement element comprises a pin cooperating with a first guide arranged on the cam shaft and the second engagement element comprises a pin cooperating with a second guide arranged on the cam shaft;

wherein the first engagement element and the second engagement element are alternately adjustable between an initial position and a switching position;

wherein the first engagement element does not contact the first guide when in the initial position and cooperates with the first guide when in the switching position;

wherein the second engagement element does not contact the second guide when in the initial position and cooperates with the second guide when in the switching position;

at least one control shaft, the at least one control shaft including at least one control cam group, the at least one control cam group including a first control cam mounted to the at least one control shaft and a second control cam mounted to the at least one control shaft, the first control cam including a cam lobe corresponding to the first engagement element and the second control cam including a cam lobe corresponding to the second engagement element; and wherein the at least one control shaft is rotatable about a longitudinal axis between a starting position and a rotational position such that in the rotational position the first engagement element adjusts into the switching position via the cam lobe of the first control cam, and the second engagement element adjusts into the switching position via the cam lobe of the second control cam in an alternating manner.

2. The valve drive according to claim 1, wherein the at least one control shaft includes a plurality of control cam groups, and wherein the at least one adjusting device activates via a respective control cam group of the plurality of control cam groups such that a cam profile shifts between at least two different cam profiles.

3. The valve drive according to claim 1, wherein the at least one control shaft includes at least two partial control shafts each including at least one control cam group, and wherein the at least one adjusting device activates via the at least one control cam group such that a cam profile adjusts between at least two different cam profiles.

4. The valve drive according to claim 1, wherein the at least one control shaft includes an inner shaft and a rotationally fixed outer shaft arranged coaxially thereto, the inner shaft rotatably arranged in the outer shaft, and wherein the first control cam and the second control cam are mounted to the inner shaft in a rotationally fixed manner.

5. The valve drive according to claim 1, wherein the at least one control shaft includes an inner shaft and an outer shaft arranged coaxially thereto, the inner shaft and the outer shaft rotatable relative to one another, and wherein one of i) the first control cam is mounted to the inner shaft and the second control cam is mounted to the outer shaft and ii) the second control cam is mounted to the inner shaft and the first control cam is mounted to the outer shaft in a rotationally fixed manner.

6. The valve drive according to claim 1, wherein the at least one control shaft is a rocker shaft including at least one rocker arm rotationally arranged on the rocker shaft.

7. The valve drive according to claim 1, further comprising a control shaft drive.

8. The valve drive according to claim 7, wherein the control shaft drive is one of a belt drive, a gear drive, and an adjusting drive.

9. The valve drive according to claim 1, wherein the at least one control shaft includes a spring resetting arrangement.

10. The valve drive according to claim 9, wherein the spring resetting arrangement includes at least one of a torsion spring, a helical spring, and a flexible spring.

11. The valve drive according to claim 1, wherein the first guide and the second guide are arranged on a slide guide of the cam shaft.

12. The valve drive according to claim 1, wherein the first guide is arranged on a first slide guide of the cam shaft and the second guide is arranged on a second slide guide of the cam shaft.

13. The valve drive according to claim 1, wherein the first engagement element and the second engagement element are structured and arranged to extend radially relative to the cam shaft.

14. An internal combustion engine comprising the valve drive of claim 1.

* * * * *